United States Patent [19]

Droz

[11] 4,089,084

[45] May 16, 1978

[54] INTERNAL HINGE

[76] Inventor: Daniel M. Droz, 6501 Bartlett St., Pittsburgh, Pa. 15217

[21] Appl. No.: 806,518

[22] Filed: Jun. 14, 1977

[51] Int. Cl.[2] ..... E05D 9/00; E05D 15/00; E05D 11/10

[52] U.S. Cl. ..... 16/128 R; 16/139; 182/165; 403/116

[58] Field of Search ..... 16/139, 128, 158, 159; 182/165; 403/116, 117; 248/289, 291

[56] References Cited

U.S. PATENT DOCUMENTS

| | | | |
|---|---|---|---|
| 204,191 | 5/1878 | Brady | 182/165 |
| 2,604,011 | 7/1952 | Cohen | 403/116 |
| 2,646,037 | 7/1953 | Cook et al. | 403/116 |
| 3,401,951 | 9/1968 | Bloom | 403/116 |
| 3,554,294 | 1/1971 | Morkoski | 16/139 |
| 3,616,469 | 11/1971 | Injeski | 403/116 |

*Primary Examiner*—Ronald Feldbaum

*Attorney, Agent, or Firm*—Nelson E. Kimmelman

[57] ABSTRACT

An internal hinge for use with first and second members such as the front and back legs of ladders in which there is a generally tubular means having a first portion adapted to be inserted into an aperture in the first member and a second portion adapted to be inserted into a second aperture in the second member. The apertures are aligned and adjacent one another and in the first portion there are two peripheral slots opposite one another through which a rigid pin passes, the ends of the pin being fastened to the first member. The second portion has two aligned transverse apertures through which a second pin is passed from outside the second member. Other embodiments include detented slot means for allowing selected angular positions of the legs, non-round tubular means, three-pin versions allowing two members to pivot with respect to a third, etc. Other embodiments include plant stands, easels, saw-horses, collapsible tables and collapsible seats.

12 Claims, 15 Drawing Figures

FIG. 5
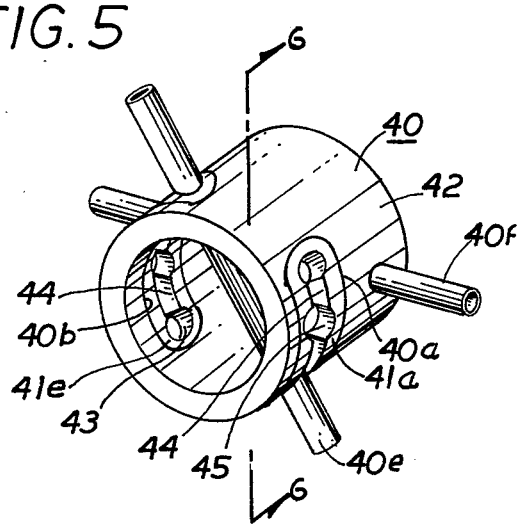
FIG. 6
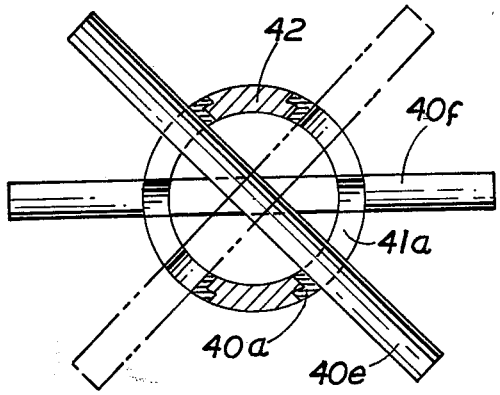
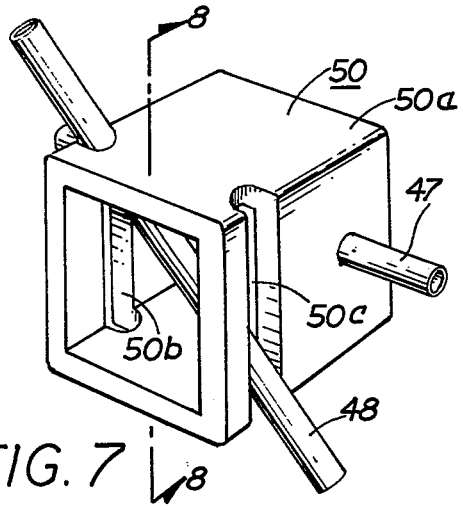
FIG. 7
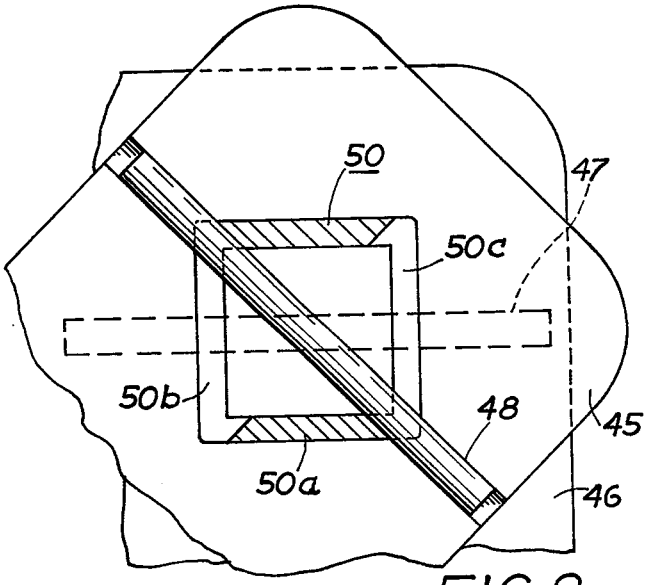
FIG. 8
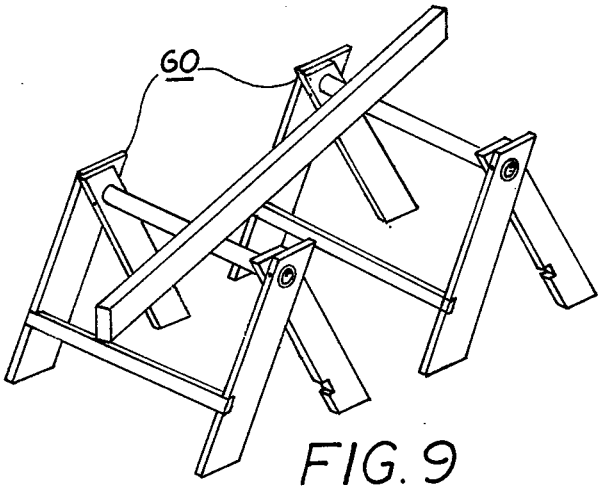
FIG. 9
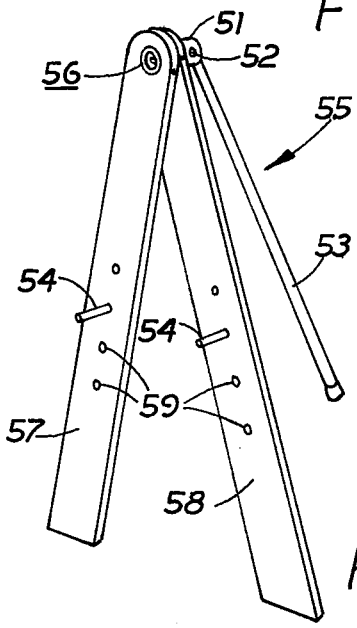
FIG. 10

INTERNAL HINGE

BACKGROUND OF THE INVENTION

A. Field of the Invention

This invention relates to hinges and especially to internal hinges for allowing relative pivotal movement between two members to which the internal hinge is coupled.

B. Prior Art

While the hinge art goes back to antiquity, most hinges have had unsightly parts protruding from either both of the members that they join. Furthermore, most hinges, especially those intended for use with pin members of pivoting relation with one another, were so constructed that they did not permit the two members to collapse or fold so that the two members were substantially congruous with one another thereby enabling storage in very limited space. Also, they had to be used with external means for limiting the angular pivotal movement in certain cases where it was necessary for insuring stability such as in ladders. These added stop means were often nondecorative and fuctioned in a non-positive way.

It is to these shortcomings and disadvantages of the prior art that the present invention is directed.

SUMMARY OF THE INVENTION

An internal hinge for use with at least a first and second member comprising a generally tubular part adapted to be inserted into a first aperture formed in a first member and a part adapted to be inserted into a second aperture in a second member, said apertures being aligned and adjacent one another, said tubular part having slot means formed in its periphery, retaining means adapted to engage said first member and said slot means for connecting said first member to said tubular part.

BRIEF DESCRIPTION OF THE DRAWINGS

FIG. 5 shows another form of internal hinge with detents permitting the user of the apparatus in which the hinge is employed a choice of several angular position;

FIG. 6 is a sectional view of the apparatus shown in FIG. 5 taken along the section line 6—6 in the direction indicated;

FIG. 7 shows another embodiment of the internal hinge according to the present invention;

FIG. 8 is a fragmentary sectional view of the apparatus shown in FIG. 8 as used in a typical environment;

FIG. 9 shows other structures embodying the novel internal hinges according to the present invention;

FIG. 10 is an easel-type structure in which the novel internal hinge according to the present invention may be incorporated;

DETAILED DESCRIPTION OF THE DRAWINGS

Figure 1:
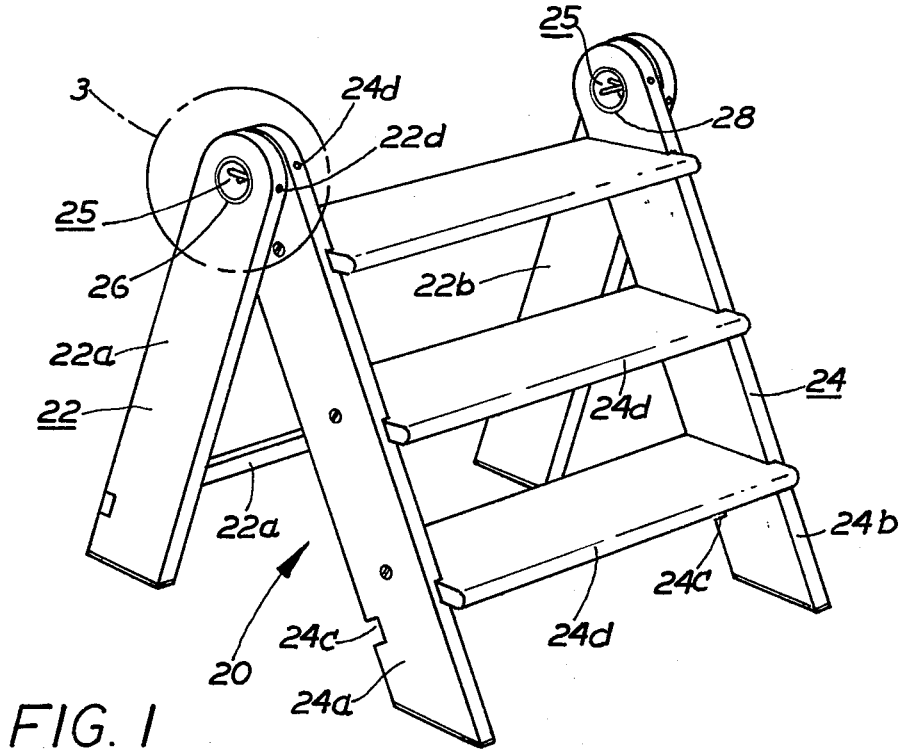
FIG. 1 is a perspective view of a ladder employing the novel internal hinge according to one form of the present invention.

FIG. 1 shows a novel step-ladder which incorporates the novel internal hinge according to the present invention. The step ladder indicated generally at the numeral 20 has two pivoting portions shown generally at 22 and 24 which are connected by an internal hinge indicated generally at the numeral 25. As seen in FIG. 1, the hinges 25 have their outer parts inserted in round apertures 26 formed in the members *22a* and *22b* and their inner parts inserted in apertures 28 formed in members *24a* and *24b*, the apertures being aligned with one another.

Figure 3:
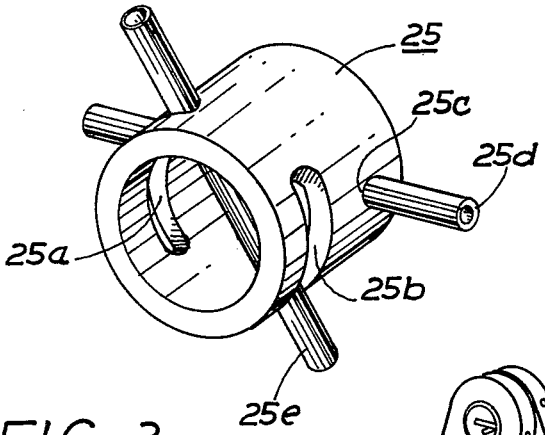
FIG. 3 is an enlarged perspective view of the internal hinge used in the ladder shown in FIG. 1.

As seen in FIG. 3, the hinge 25 has two circumferential slots *25a* and *25b* disposed opposite to one another. It also includes transverse apertures *25c* disposed opposite and in alignment with one another through which a tubular retaining pin *25d* passes, the retaining pin *25d* being driven into place after the tubular portion of the hinge is inserted in the aperture 28 in member *24a* and the apertures *25c* are in alignment with corresponding apertures *24d* formed in the upper parts of *24a* and *24b*.

Also associated with the hinge 25 is a second tubular retaining pin *25e* that is driven through aligned apertures *22d* in the upper parts of members *22a* and *22b* so that it passes through the slots *25a* and *25b*. The retaining pins *25d* and *25e* may be of the so-called "roll pin" type which have a slight radial compressibility so that they may be compressed inwardly when first placed in a hole of slightly smaller diameter and when they are driven in their tendency to decompress maintains them snugly in that hole. The tubular portion of the hinge 25 may be made of a suitable high-impact plastic or any other suitable material including metal.

Figure 2:
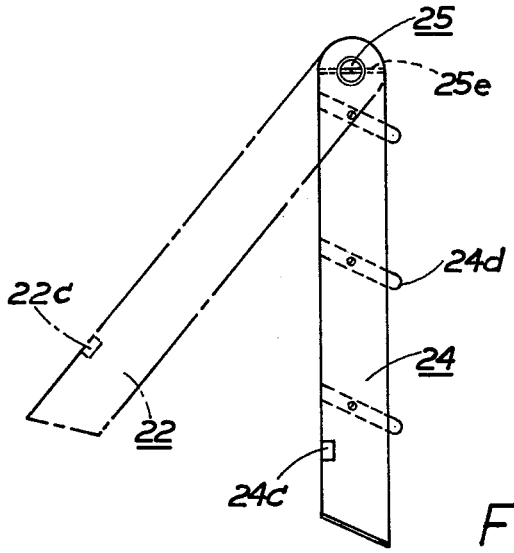
FIG. 2 is a side elevational view, partly in phantom, of the apparatus shown in FIG. 1.

It is one of the significant advantages of the present invention that, as shown in FIG. 2, when the novel hinge 25 is used, a ladder such as ladder 20 may be made to collapse so that the members *22a* and *24a* are substantially flush and congruously overlie one another as well as their counterparts *22b* and *24b*. Therefore, unlike other ladders, the collapsed ladder is quite compact and very easy to store. Furthermore, since the hinge is internal to the collapsing members, the invention enables the ladder to have a finished, uncluttered, and non-functional look which is highly attractive.

The respective lengths of the slots *25a, 25b* determine the angle formed by the members 22 and 24. Since the members *22a, 24a* and *22b, 24b* do congruously overlie one another when the ladder is collapsed, the rear edges of the members *24a* and *24b* are provided with cut-outs *24c* which are shaped to correspond to the general cross-section of the bracing member *22c* attached to member 22. Of course, the portion 24 is provided with steps *24d* attached to the side members *24a* and *24b* in any known fashion such as by screws, dowels, or the like.

Figure 4:
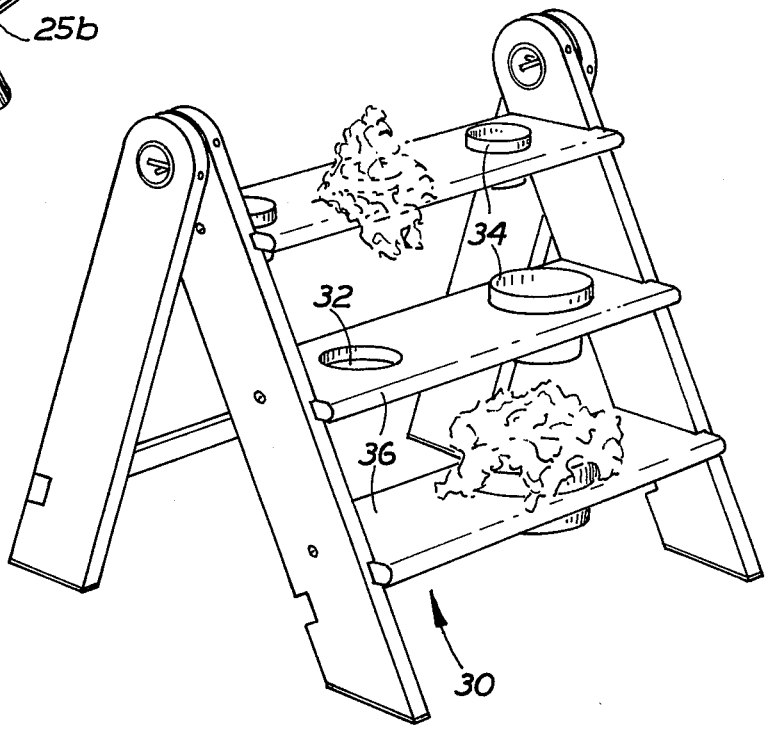
FIG. 4 shows a plant stand utilizing the novel internal hinge according to FIG. 3.
Figure 11:
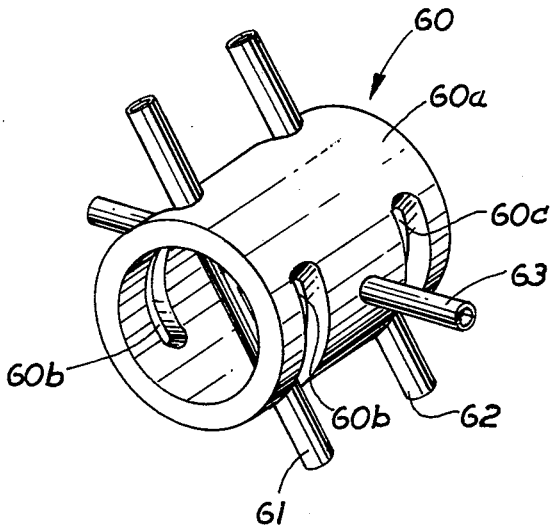
FIG. 11 shows still another form of the internal hinge adapted to couple three members together.

FIG. 4 shows still another apparatus in which the internal hinge can be used. It is a plant stand 30 whose construction is almost identical to that of the ladder except that the "steps"or shelves 26 are provided with apertures 32 of uniform or different radii in which flower pots 34 may be placed.

FIG. 5 shows another form of the invention in which the slots formed in the tubular member 42 are provided with detents to allow adjustment of the pivoting parts of the ladder or plant stand to any one of three different steadystate positions rather than just the two extreme positions permitted by the embodiment of FIGS. 1–3. Thus, the hinge 40 is similar to hinge 25 having a fixed retaining pin 40*f* and two slots 40*a* and 40*b* in which somewhat resilient detent subassemblies 41*a* and 41*b* are fixed. The members 41*a* and 41*b* can be, for example, of a plastic material which yields more than the material of the rigid main cyclindrical tubular portion 42. The subassemblies 41*a* and 41*b* may be cemented in, screwed in, or otherwise fixed within the slots 40*a* and 40*b*. Each of the subassemblies 41*a*, 41*b* has three almost circular detent areas 43 into which the pin 40*e* can snugly fit. Between these generally circular areas there are narrower channels 44 having a width sufficiently smaller than the diameter of the pin 40*e* such that it requires considerable force to move the pin 40*e* in its plane from one detent area 43 to the adjacent area 43. As a result, the hinge 40 permits the adjustment of the two pivoting members to three detented positions. Of course, fewer or more detent areas may be provided depending on the size of the hinge, the diameter of the movable retaining pin, and the length of the slots.

FIG. 7 shows still another embodiment of the invention in a hinge 50 having a tubular portion 50*a* of generally square cross-section, although it could just as well be rectangular or polygonal. In this embodiment, the slots 50*b* and 50*c* are mostly straight with right-angled channel portions thereof formed in the top and bottom of the tube as shown. FIG. 8 shows how hinge 50 is used to couple two members 45 and 46 in pivotal relation to one another with retaining pins 47 and 48 passing through them.

FIG. 9 shows a pair of saw horses 60 which may use internal hinges of the type shown in FIGS. 3 or 5, for example.

FIG. 10 shows a novel easel 55 which incorporates an internal hinge assembly 56 which may be of the type shown in FIG. 5 or in FIG. 3, for example. It has two front upstanding portions 57 and 58 each of which is equipped with vertically arrayed apertures or recessed portions 59. Pegs 54 may be inserted in any two or more corresponding ones of the apertures 59 to hold a painting or other planar material on the easel. Attached to the back of the member 58 is a pivoting leg 53 which pivots about a horizontal pivot pin 52 in a bracket 51 extension of the tubular rear portion of hinge 56. When the right-hand peg 54 is removed, the two members may be moved so that they are congruous with one another and then the rear leg 53 may be moved forward for storage of the easel.

Figure 12:
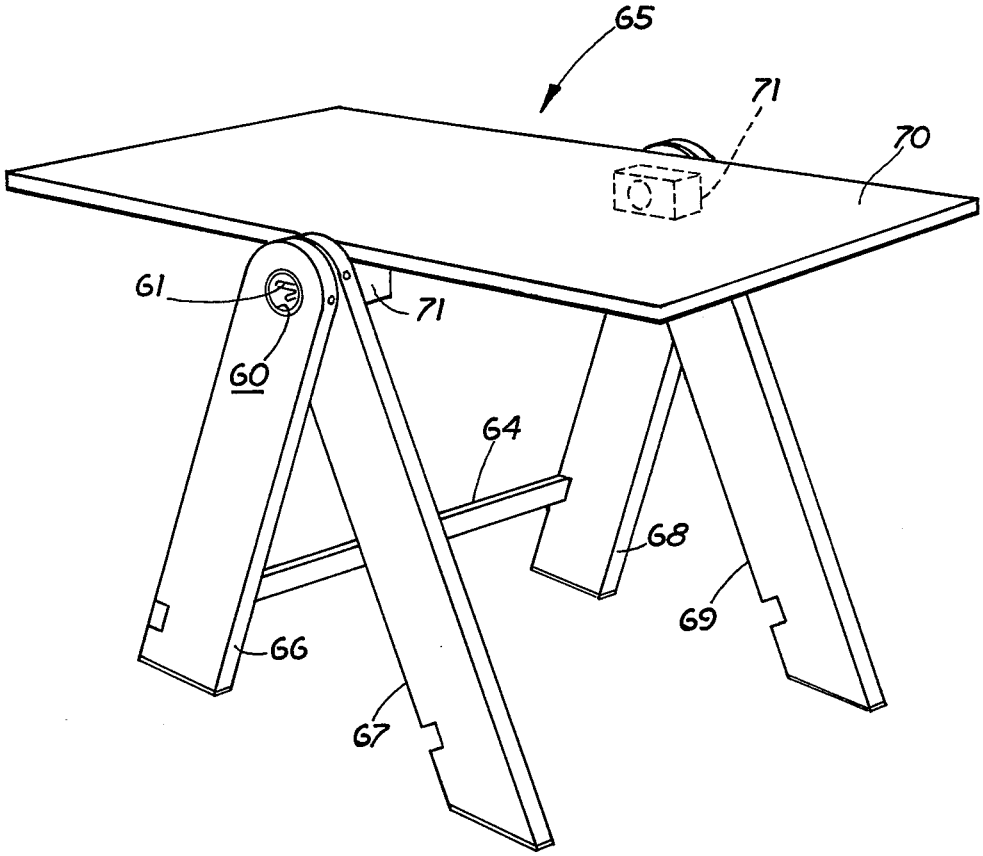
FIG. 12 is a perspective view of a collapsible table capable of using the form of the invention shown in FIG. 11.

FIG. 12 shows a third form of the novel internal hinge according to the present invention which may be used to couple three elements in pivoting relation to one another. The hinge 60 has a tubular portion 60*a*, two sets of slots 60*b* and 60*c*, two movable retaining pins 61 and 62, and a retaining pin 63 which is fixed within two opposing apertures formed in the tubular portion 60*a*. Thus, it is seen that any member in which the retaining pins 61 and 62 are located may be made pivotally movable with respect to the member with which the fixed retaining pin 63 is associated.

Figure 13:
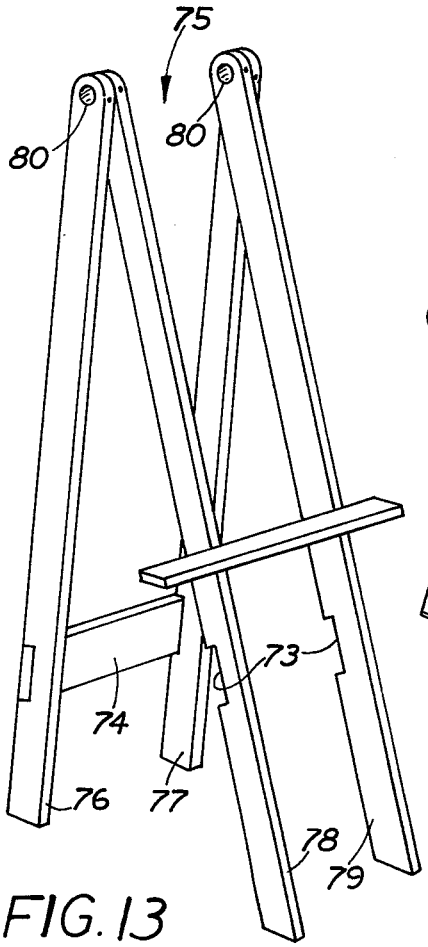
FIG. 13 shows another easel-type structure capable of using the internal hinge according to the present invention.

FIG. 13 shows a table indicated generally at the numeral 65 comprising two supporting sub-assemblies consisting of uprights 66, 67 and 68, 69 connected by a cross-brace 64 attached to the rear edge of the members 66 and 68. The members 66 and 68 are respectively pivotally coupled to the members 67 and 69 by the outer and central parts of the hinge 60 with the movable retaining pin 61 being located within apertures formed in the members 66 and 68 respectively; the fixed pin 63 passing through corresponding aligned apertures in the members 67 and 69 as well as the aligned, apertures in the tubular portion tubular portion 60*a*. The innermost portion of the hinge 60 which includes the movable pin 62 is positioned within an aperture in a hinge box 71 that is attached to the underside of the tray or table top 70 at its longitudinal mid-point and near the edges thereof. By this construction, the table 13 may have its legs 66, 68 and 67, 69 collapsed and its table top 70 swung vertically with respect to the collapsed legs so that it can be stored in a very narrow space.

Figure 14:
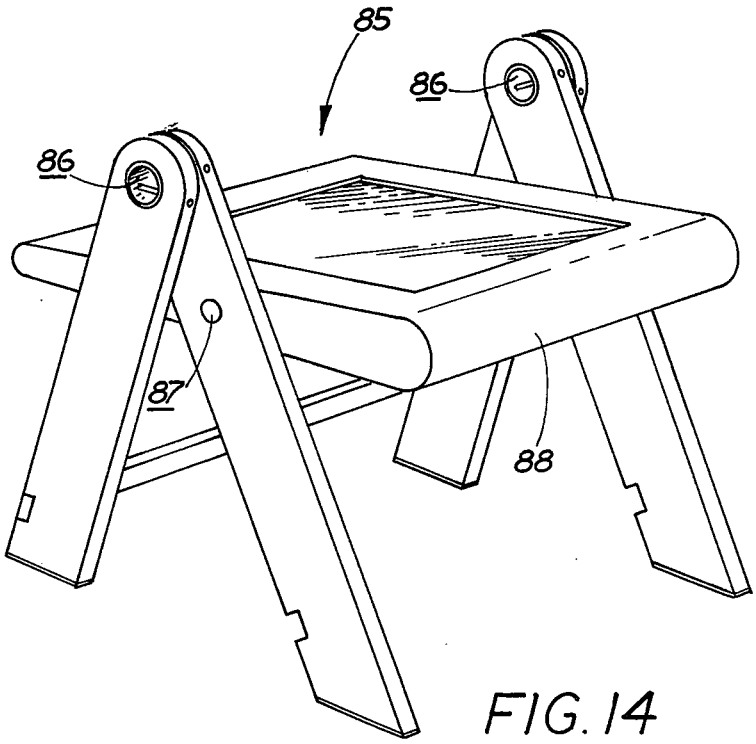
FIG. 14 shows another structure in which two of the novel internal hinges may be used.

FIG. 14 shows still another easel indicated generally at the numeral 75 having pairs of upright legs 76, 77 and 78, 79, the rear legs being connected by a brace 74 and the front legs having appropriate cut-outs 73 to accommodate the brace when the easel is collapsed. The easel shelf 72 is attached in any desired manner to the front legs 78, 79. The sets of legs are maintained in pivotal relation by internal hinges 80 which may be of the type shown in FIGS. 3 and 6, for example.

Figure 15:
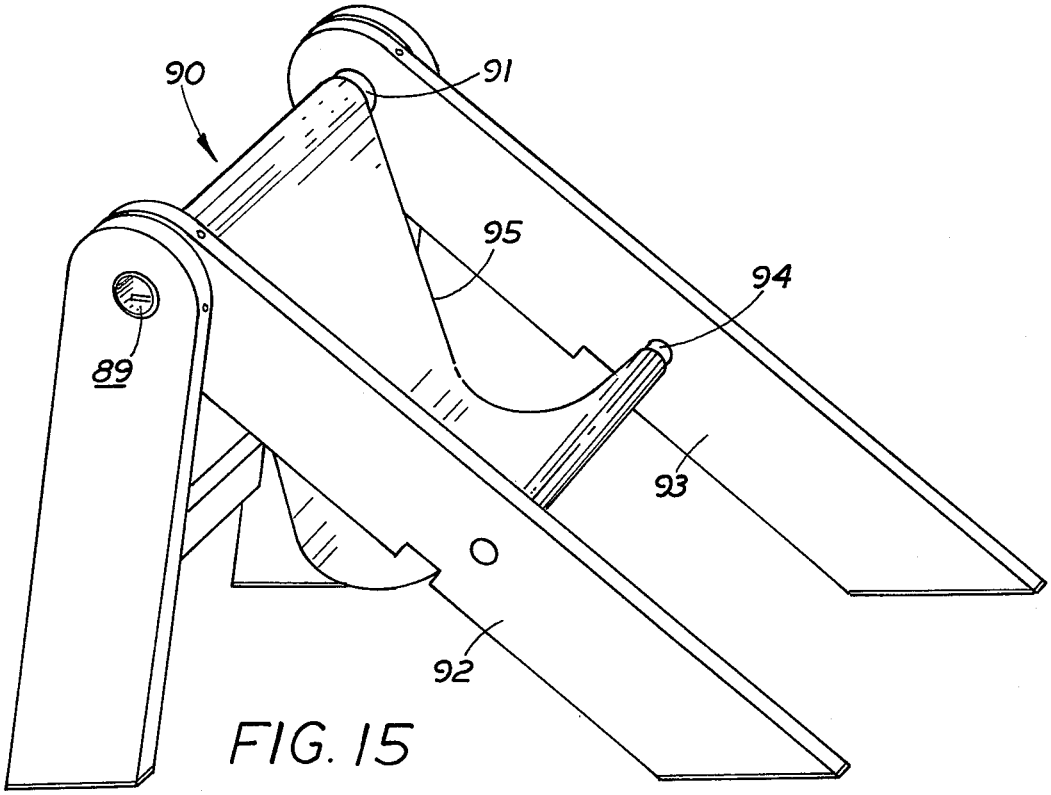
FIG. 15 is a perspective view of a folding chair into which the novel internal hinge may be incorporated.

FIG. 15 shows a collapsing stool or table indicated generally at the numeral 85 having two sets of internal hinges 86 and 87, respectively, only one of the latter being visible. The set 86 of internal hinges couples the front and back sets of legs pivotally to one another in much the same manner as depicted in FIG. 14. The set of hinges 87 allows pivotal movement of the feet or table portion 88 with respect to the front legs and allows the seat to pivot to a generally vertical direction when the legs are collapsed for storage. Of course, appropriate stop or limit means may be provided on the inside surfaces of the rear set of legs to keep the table portion 88 horizontal when weight is applied thereupon.

FIG. 16 shows another embodiment of the invention as used in a collapsible sling-type chair. The general construction of the front and back sets of legs is very similar to that shown in FIG. 15 except that the front legs may be more elongated. Internal hinges such as hinge 89 are used to couple the sets of legs together and there is a strong tubular member 91 which is attached to aligned apertures formed in the inward surfaces of the front legs 92, 93. Another strong horizontal rod 94 is positioned lower down on the front set of legs 92, 93 and a sling-type of back 95 is fastened to the upper and lower rods 91 and 94, respectively, hanging loosely to conform to the body of the user in a sitting position. Of course, if the hinge 89 is made of metal, the rod 91 may merely be an extension of the hinges on either side.

Some other forms of the invention are possible as well as other embodiments thereof. For example, while the invention has been shown as having a fixed pin attached to one of the pivoting members, there may be instances in which this pin may be unncessary. If, for example, the pin 25*d* and the apertures 25*c* in the hinge 25 shown in FIG. 3 are not used, the right-hand portion of the hinge 25 may be equipped with a flange at its right edge slightly larger than the aperture in which the hinge is placed. The outer surface of the tubular portion of the right half of the hinge 25 could be provided with slightly raised angular projections angled toward the right such that the modified hinge could be inserted from the inside of the legs **24*a* and 24*b* by hammering or the like. Thus the right-hand portion of the modified hinge 25** would be prevented from leftward movement by the flange and from being extracated in the opposite direction by the projections which would cause increased resistence to such movement.

Still other ways of retaining the right half of the hinge in its aperture may be used such as, for exmaple. cementing or threading so that a pin **25*d* would not be necessary. This would have the added virtue of making unnecessary any externally visible apertures such as the aperture 24*d* in FIG. 1. Still another way of avoiding such an aperture is to use pins or set screws inserted internally from the right-hand side of the bore of the tubular portion of the internal hinge assembly which would pass from the inside out of the apertures 25*c* to engage the member 24*a* and keep the hinge 25** connected to it.

It should also be appreciated that the novel hinge could be made so that it would have no aligned apertures (such as **25*c* - FIG. 3) for a stationary pin, but would have two sets of laterally displaced slots, either as shown in FIG. 12** or displaced radially about the periphery to enable the first and second members to assume a greater variety of mutually angular orientations.

For esthetic purposes, the internal hinges may have their outer visible ends covered with painted or decorated caps that are retained frictionally within the bores of the hinges.

What is claimed is:

1. An internal hinge for use with at least a first and second member comprising:

a. a generally tubular means having a first part adapted to be inserted into a first aperture formed in said first member and a second part adapted to be inserted into a second aperture in said second member, said apertures being aligned and adjacent one another, said tubular member having a slot means formed in the periphery of said first part, said tubular member also having means formed in said second part for enabling said second part to be connected to said second member, and b. retaining means adapted to engage said first member and said slot means for connecting said first member to said first part.

2. The hinge according to claim 1 with the addition of second retaining means adapted to engage said second member and said enabling means for connecting said second member to said second part.

3. The hinge according to claim 2 wherein at least one of said retaining means is an elongated rigid member.

4. The hinge according to claim 2 wherein both of said retaining means are substantially rigid pins.

5. The hinge according to claim 2 wherein said means for enabling said second part to be connected to said second member comprises aperture means.

6. The hinge according to claim 5 wherein said aperture means comprises two aligned apertures and wherein said second retaining means is an elongated rigid member having a cross-section substantially the same as that of said aligned aperture means.

7. The hinge according to claim 2 wherein said slot means comprises two slots disposed generally opposite one another and wherein the width of said slot is larger than the thickness of said retaining means.

8. The hinge according to claim 1 wherein said slot means is formed with detents for said retaining means to enable positioning of said first and second members in a plurality of releasably fixed angular orientations.

9. The hinge according to claim 8 wherein said detents are formed of yieldable materials in said slot means and comprise a plurality of enlarged aperture areas which communicate with one another by narrower channel areas.

10. The hinge according to claim 1 wherein said tubular means is generally circular in cross-section.

11. The internal hinge according to claim 1 wherein said tubular means has a generally polygonal crosssection.

12. The hinge according to claim 1 wherein the slot means comprises at least two pairs of slots, the slots of each pair being disposed substantially opposite one another.

* * * * *